US005725440A

United States Patent [19]

Finney

[11] Patent Number: 5,725,440

[45] Date of Patent: Mar. 10, 1998

[54] LASER-GUIDED GOLF CLUB PUTTER

[76] Inventor: Mark J. Finney, 2354 Hunt Rd., Camillus, N.Y. 13031

[21] Appl. No.: 853,333

[22] Filed: May 8, 1997

Related U.S. Application Data

[63] Continuation-in-part of Ser. No. 631,538, Apr. 12, 1996, abandoned.

[51] Int. Cl.[6] ..... A63B 69/36

[52] U.S. Cl. ..... 473/220; 473/267; 473/268

[58] Field of Search ..... 473/220, 267, 473/268

[56] References Cited

U.S. PATENT DOCUMENTS

| | | | |
|---|---|---|---|
| 3,953,034 | 4/1976 | Nelson . | |
| 4,925,190 | 5/1990 | Learned | 473/286 |
| 5,029,868 | 7/1991 | Cloud . | |
| 5,082,282 | 1/1992 | Hernberg | 473/220 |
| 5,165,691 | 11/1992 | Cook . | |
| 5,169,150 | 12/1992 | Tindale . | |
| 5,213,331 | 5/1993 | Avanzini . | |
| 5,217,228 | 6/1993 | DeAquilar . | |
| 5,435,562 | 7/1995 | Stork et al. | 473/220 |
| 5,464,221 | 11/1995 | Carney | 473/220 |

*Primary Examiner*—George J. Marlo
*Attorney, Agent, or Firm*—Wall Marjama & Bilinski

[57] ABSTRACT

A golf club putter is provided with a laser generator positioned in the shaft of the club. The laser generator is activated when a push button is depressed, and emits a beam of light downward, reflecting off a mirror positioned near the clubface and exits through an aperture to illuminate a target spot, thus indicating the direction in which the golf ball will travel. In another embodiment, a light beam splitter is provided to reflect a first portion of the light beam in a horizontal plane to illuminate a target spot, and a second portion of the light beam coaxially of the shaft in a selected pattern that is projected on the ground. The golfer may use this putter both on a practice green or in actual play to improve the alignment of his putter with the hole or other target.

12 Claims, 5 Drawing Sheets

LASER-GUIDED GOLF CLUB PUTTER

This application is a continuation-in-part of application Ser. No. 08/631,538, filed Apr. 12, 1996, now abandoned.

BACKGROUND OF THE INVENTION

This invention relates generally to golf, and specifically to a laser-guided golf club putter for helping golfers improve their putting game.

Many products have been created to help a golfer improve his game. Among those, attempts to utilize lasers to illustrate the direction of impending ball travel. However, many of these devices are cumbersome due to the addition of parts to the club, or the need for a specialized target to be used.

U.S. Pat. No. 3,953,034, issued to Nelson, teaches use of a laser beam and mirror mounted on the shaft of a golf club to project onto the ground a line of light illustrating the direction the club face is pointing. U.S. Pat. No. 5,165,691, issued to Cook, teaches use of a laser beam assembly mounted on the club face of a putter to provide singular or parallel laser beams extending outwardly therefrom. U.S. Pat. No. 5,213,331, issued to Avanzini, teaches a laser unit mounted onto the putter head of a conventional putter. These patents all teach mounting a laser unit onto a golf club to project a light beam. However, the protruding hardware may need to be removed before going onto the golf course and the extra weight or bulk may be hindersome to the golfer.

U.S. Pat. No. 5,029,868, issued to Cloud, teaches use of a golf practice device having a lightsource positioned in the shaft, emitting light from the putter face directed at a target having a reflective device for indicating accuracy of aim. U.S. Pat. No. 5,169,150, issued to Tindale, teaches use of a golf putter having a laser mounted in a bore in the center of the putter face, directing a lightsource at a target, in order to measure the extent of misalignment. These devices are for practice use only, and cannot be used during the course of normal play, as they require a specialized target.

U.S. Pat. No. 5,217,228, issued to De Aguilar, teaches use of a golf club having a laser beam generator, which emits a light beam from the midpoint of the shaft to indicate the direction in which the ball will travel. However, the indication of direction from the midpoint of the shaft is not accurate, as a golf club is not held perpendicular to the ground. Instead, golf clubs are held at an angle away from the body, resulting in a large margin of error when the light beam is emitted from the midpoint of the shaft. The invention herein described emits a light beam very close to where the ball is located, thereby rendering the light beam much more accurate. Furthermore, the placement of the ball does not hinder the light beam's path.

The laser-guided golf putter as described herein has a dual intended purpose. First, the laser-guided putter can be used as a training or practicing device to visually assist the golfer in aligning the putter's clubface to a desired illuminated target or spot. This can be accomplished both indoors and outdoors and on an actual practice putting green. The aligned putter clubface with the aid of the illuminated spot provides instant visual biofeedback necessary to control the putting stroke, and ultimately, the direction of the golf ball towards the illuminated target spot. Secondly, the laser-guided golf putter is an actual putter that can be used during normal play on any golf course or miniature golf course. The putter is self-contained and ruggedized to withstand the physical abuse that any other putter on the market would experience. There is no . protruding hardware and the golfer does not have to remove any hardware when transferring from the practice area to the golf courses. Thus, the performance of the putter will not be hindered.

OBJECTS AND SUMMARY OF THE INVENTION

It is therefore a primary object of the invention to improve golf clubs.

It is another object of the invention to provide a golf putter which visually assists the golfer in aligning the putter's clubface with a desired illuminated target or spot.

Another object of the invention is to provide a laser-guided putter which has no protruding or specialized hardware.

Another object of the invention is to provide a putter having a light beam emitted from a location very close to the golf ball, while allowing the golf ball to be properly placed without any interference.

Yet another object of the invention is to provide a putter which is rugged enough to withstand normal handling on a golf course.

A further object of the invention is to provide a laser-guided putter whose performance is not hindered by the addition of the components necessary for the laser guidance system.

These and other objects of the invention are attained by a laser-guided golf club putter having a laser generator positioned in the shaft of the club. The laser generator is activated when a push button is depressed, and emits a beam of light downward, reflecting off a mirror positioned near the clubface and exits through an aperture in the hosel to illuminate a target spot, thus indicating the direction in which the golf ball will travel.

BRIEF DESCRIPTION OF THE DRAWINGS

For a fuller understanding of the nature and objects of the invention, reference should be made to the following detailed description of a preferred mode of practicing the invention, read in connection with the accompanying drawings, in which.

DETAILED DESCRIPTION OF THE INVENTION

Figure 1:
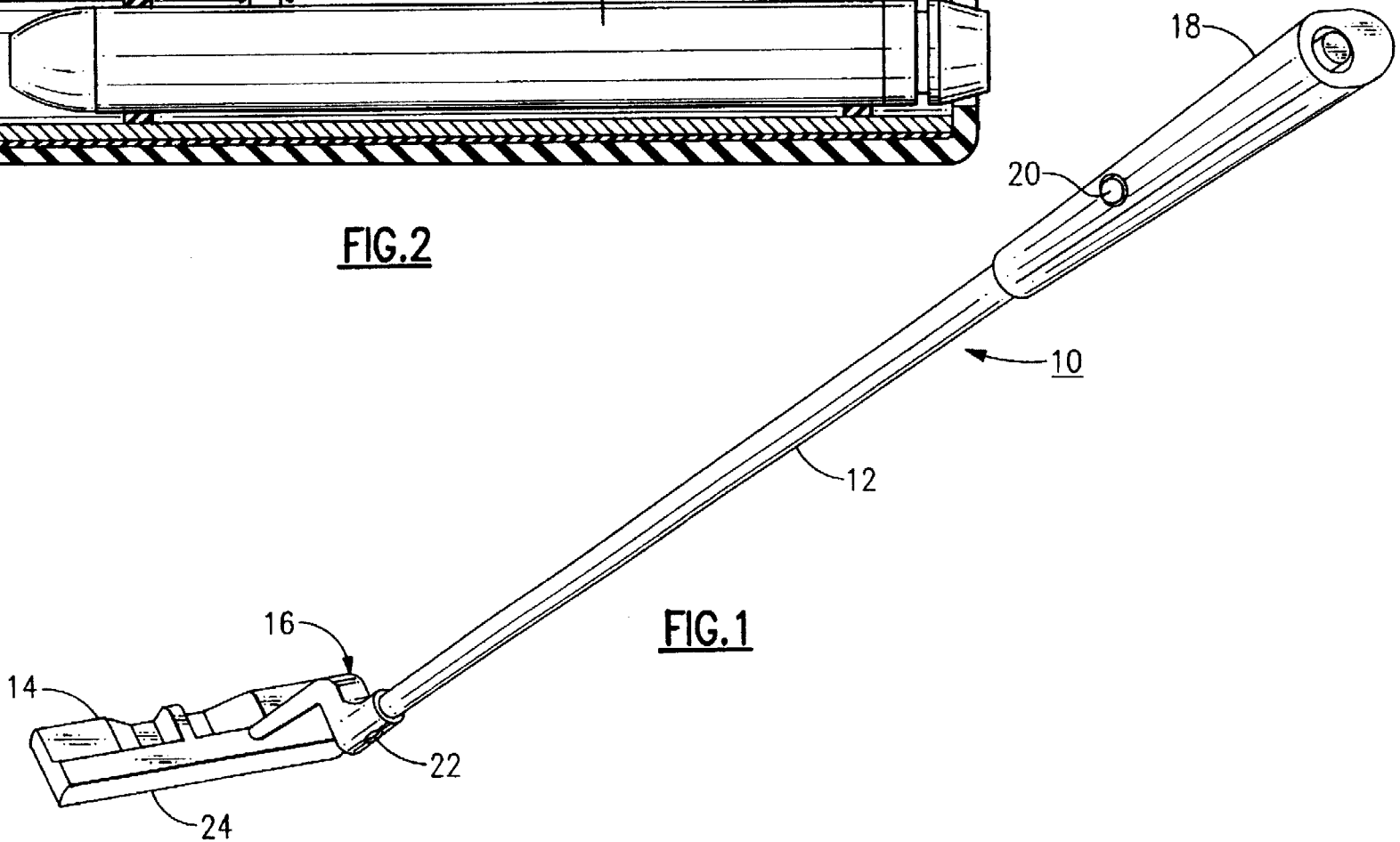
FIG. 1 is a perspective view of a laser-guided golf putter in accordance with the present invention.

In FIG. 1, a laser-guided golf putter 10 is shown, in accordance with the described invention. The putter has an elongated shaft 12, with a head 14 at the bottom end and a grip 18 at the top end. Hosel 16 connects the shaft to the head. These elements are all basic elements of golf putters and are standard in the industry. This invention requires only modification to most existing putters on the market today. Illustrated in the drawings are standard right-handed putters. The invention may be practiced similarly on left-handed putters.

A push-button switch 20, located on the grip in a location convenient for pressing while gripping the club normally, triggers the laser beam to be generated when depressed. The laser beam, preferably of visible spectrum, exits through aperture 22, in a direction perpendicular to the face 24 of the club, and illuminates the direction in which the ball will travel if hit by the club.

Figure 2:
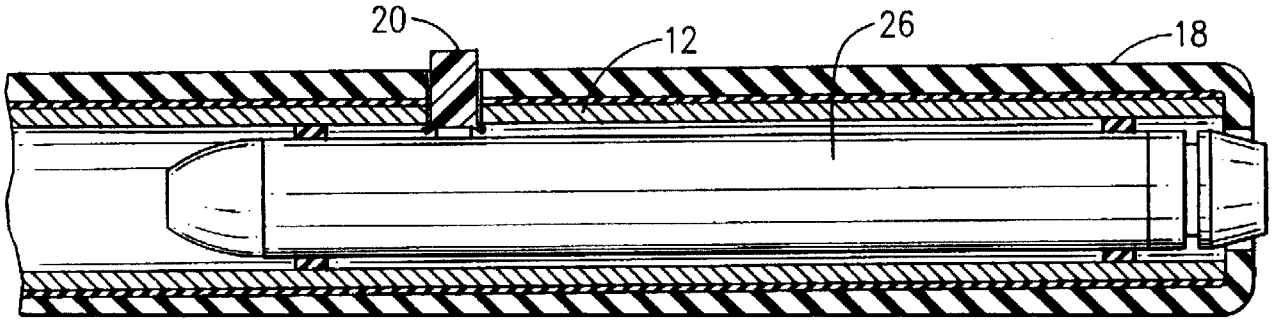
FIG. 2 is a longitudinal cross-sectional view of a laser-guided golf putter, illustrating the positioning of the laser beam generator in the shaft.

In FIG. 2, top portion of shaft having grip 18 over shaft 12 is shown. The laser generator 26 is shown inserted in the grip end of the shaft. The laser generator is downwardly pointing and is activated by push-button switch 20 which extends out above the grip. The push-button switch is located in a position which is natural for golfers to press while handling the club normally.

Figure 3:
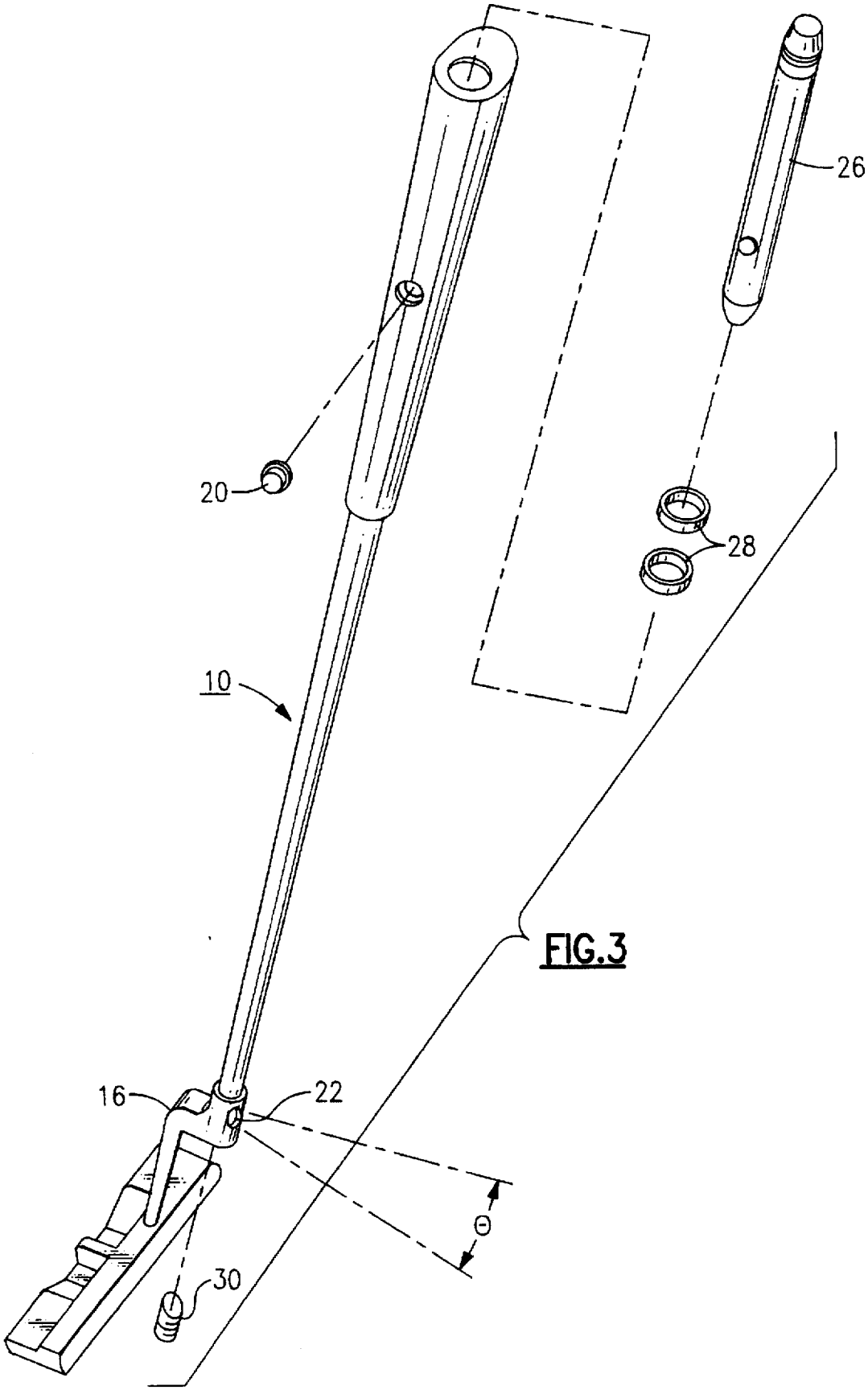
FIG. 3 is a perspective view of a laser-guided golf putter, illustrating the placement of the laser beam generator and the mirror in the club.

In FIG. 3, the golf putter is shown as assembled. The laser pointer 26 is inserted into top end of grip with rings 28, made of an elastic material such as rubber, to keep the laser generator in place. The rings also protect against any vibration or shock to the laser pointer from handling the putter. Push-button 20 is inserted into grip to be depressed when laser beam is activated. Finally, mirror 30 is inserted from bottom end of hosel 16 to deflect laser beam through aperture 22. The mirror is formed on a threaded cylinder, for ease of insertion and adjustment. As a result of using a threaded cylinder, the mirror is adjustable to reflect the laser beam through the aperture at an angle θ in the horizontal plane, parallel to the ground. Due to the hosel being offset from the location of ball placement, the horizontal adjustability of the laser beam enables the user to render more accurate the illuminated target point, based on the distance from the putter to the target.

FIG. 3 also illustrates the placement of the golf ball against the face of the club below the hosel. This proximity allows for accuracy of the directed laser beam, while allowing the golf ball to be properly placed and the shot made without the laser beam being blocked by the ball. This allows for the use of the laser beam before the shot as well as constant feedback during the shot.

Figure 4:
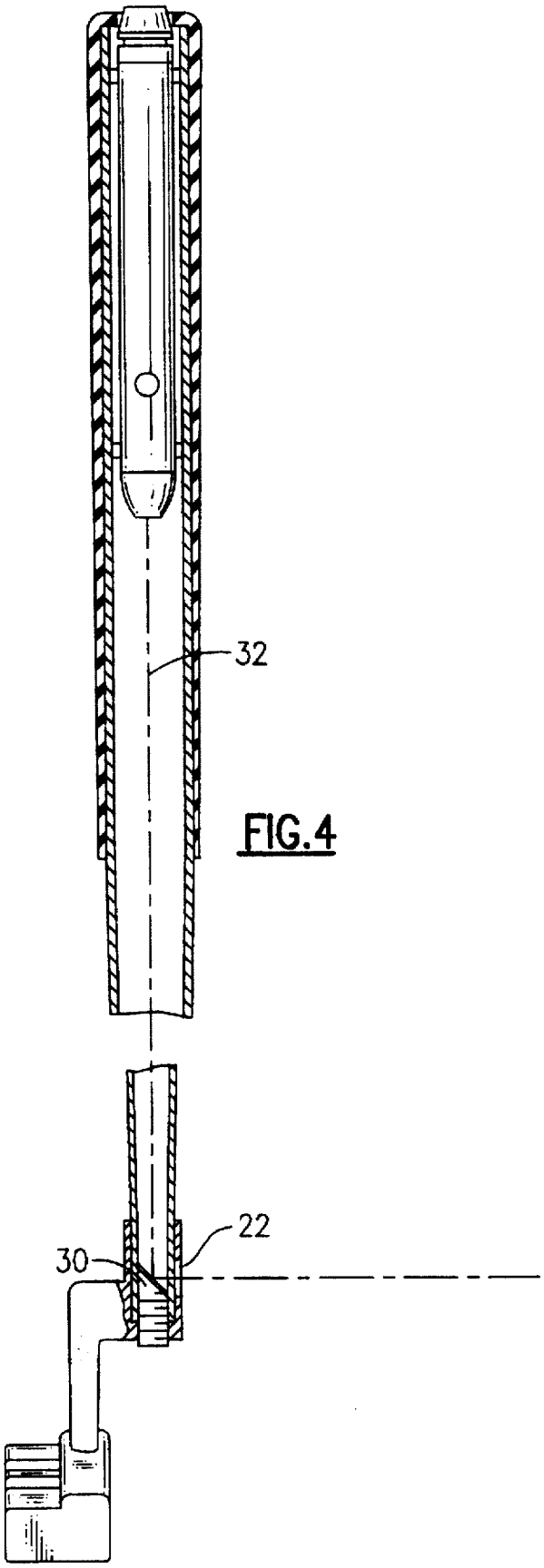
FIG. 4 is a perspective view of a laser-guided golf putter, showing a partial longitudinal cross section of the grip and shaft.

In FIG. 4, the path of the laser beam 32 is illustrated. The laser beam travels downward and reflects off the mirror 30 and proceeds through aperture 22. In the figure, a 45 degree angled mirror is shown. The resultant beam of light is reflected 90 degrees and proceeds out from the aperture parallel to the ground. This preferred embodiment is designed so that the beam of light may illuminate a flag pole in genuine play, or a wall or other simulated target in practice. Mirrors having steeper angles may be inserted or a single adjustable mirror may be utilized to deflect the laser beam through the aperture downward to illuminate a spot on the ground. This alternate embodiment may be desired in instances where there is no flagpole or other target to be illuminated besides the ground.

Figure 5:
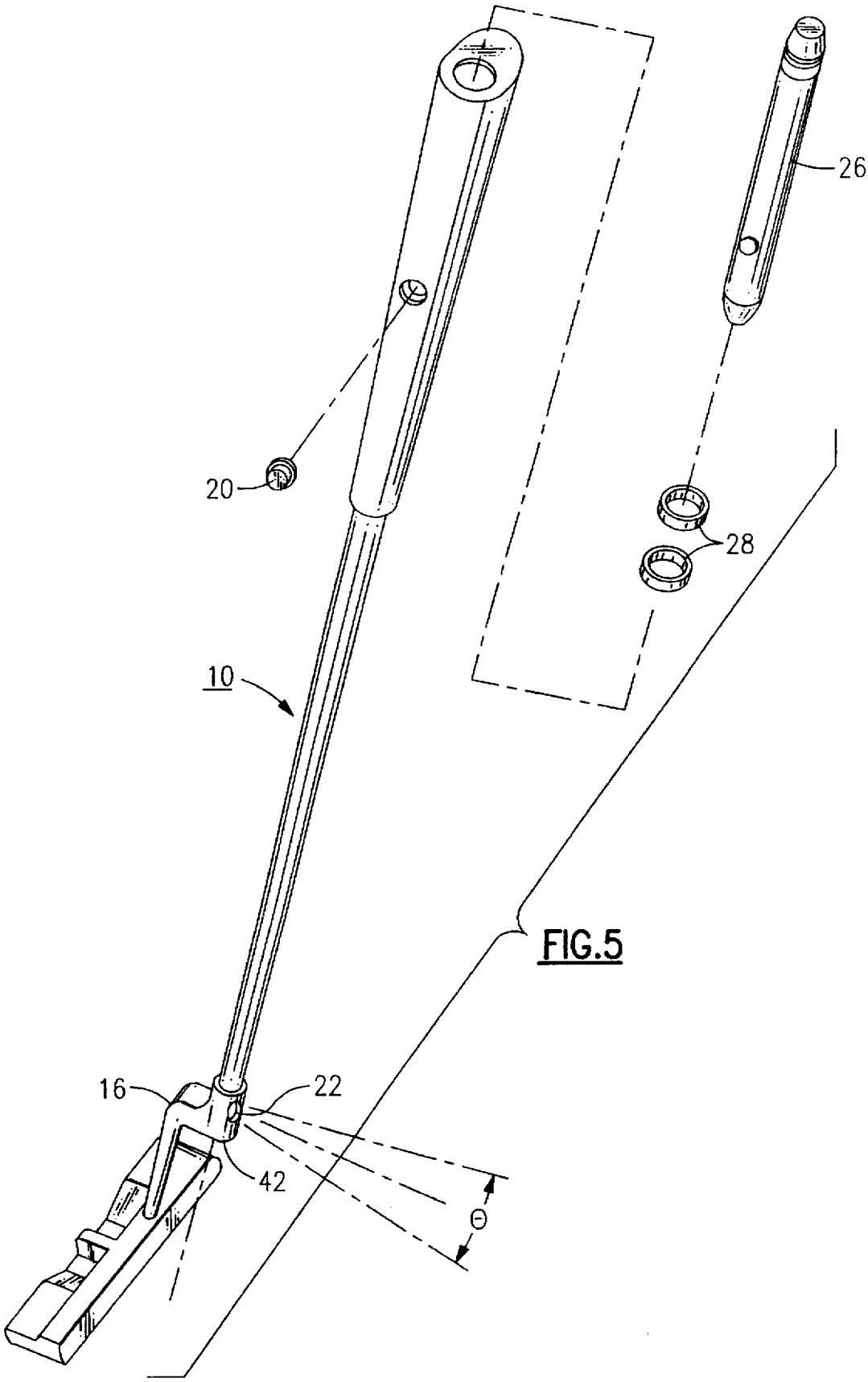
FIG. 5 is a perspective partially exploded view of a laser-guided golf putter in accordance with the present invention.
Figure 6:
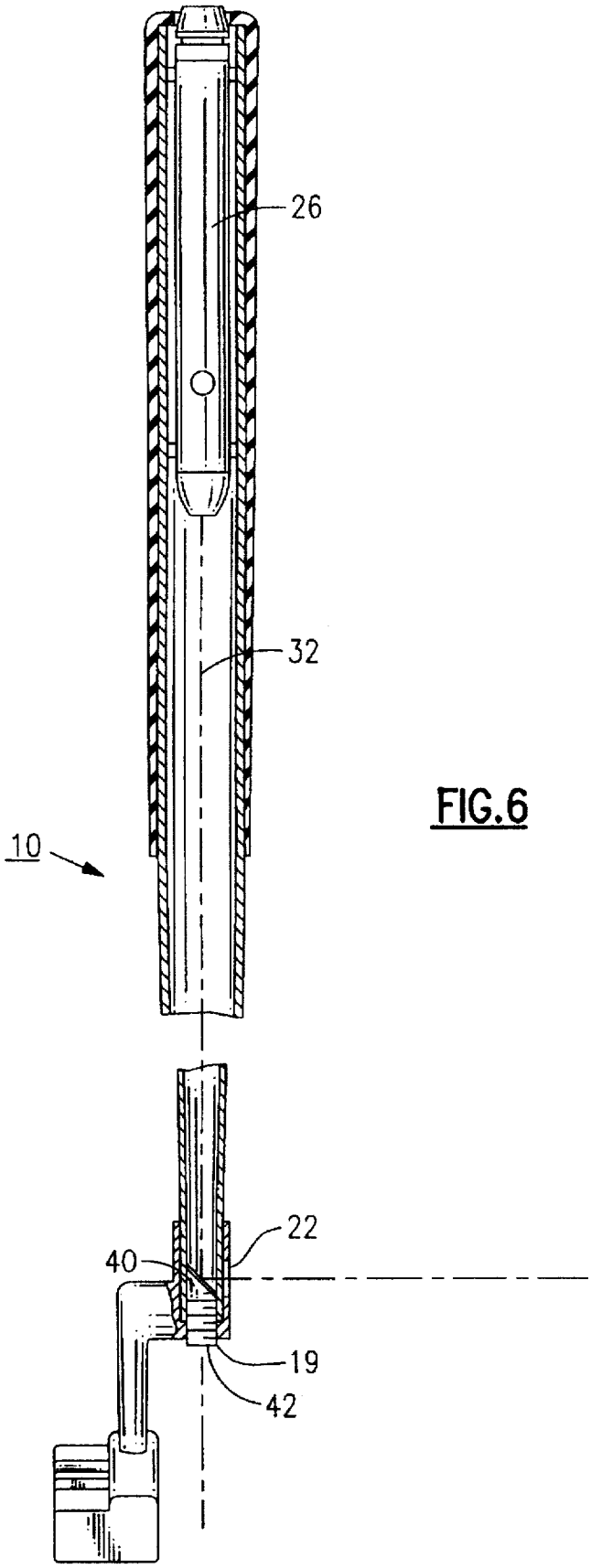
FIG. 6 is a longitudinal cross-sectional view of a laser-guided golf putter in accordance with the present invention.

Referring now to FIG. 5 and FIG. 6, there is shown another embodiment of the present invention. In this embodiment, there is a beam splitter 40 (rather than a mirror 30 as shown in FIG. 4) located in the hosel 16. Like the mirror 30 of the first embodiment, the beam splitter 40 may be formed on a threaded cylinder 19 for ease of insertion into the hosel 16 and for ease of adjustment. The beam splitter 40 reflects a first portion of the laser beam 32 so that the resultant beam is reflected at approximately a 90 degree angle and passes through the first aperture 22 parallel to the ground in the direction that the golf ball will travel when struck with the head 14. A second portion of the laser beam 32 passes through the beam splitter 40 and exits the hosel 16 at a second aperture 42 located at the base of the hosel 16. Of course, if a cylinder 19 is used to position the beam splitter 40, the second aperture 42 may be formed in the cylinder 19. The second aperture 42 allows the second portion of the laser beam 32 to pass therethrough in order to form a laser projection on the ground behind the golf ball. The second aperture 42 may be shaped to allow only a part of the second portion of the laser beam 32 to pass therethrough, thereby forming a selected pattern that is projected on the ground. For example, the projection may be shaped as a straight line which is perpendicular to the path the golf ball will travel when struck, thereby aiding the user in correctly aligning the face of the club head.

While this invention has been explained with reference to the structure disclosed herein, it is not confined to the details as set forth and this application is intended to cover any modifications and changes as may come within the scope of the following claims.

What is claimed is:

1. A laser-guided golf club for putting a golf ball, comprising:

a shaft having a first end and a second end;

a head having a bottom side, said head located at said first end of said shaft;

a grip located at said second end;

a hosel located between said shaft and said head, said hosel in communication with said shaft, said hosel including a first aperture and a second aperture therein, said first aperture located at least as high above the bottom of said head as the diameter of a standard golf ball and positioned such that said first aperture faces the direction the golf ball will travel when struck by said head, said second aperture located coaxially to said shaft;

means for generating a laser light beam, said laser generating means located within said shaft and positioned such that a laser light beam is downwardly directed through said shaft and into said hosel;

means for activating said laser generating means; and, a beam splitter located within said hosel such that said laser light beam is split such that a first portion of said laser light beam is reflected through said first aperture in the direction the golf ball will travel when struck by said head and such that a second portion of said laser light beam passes through said beam splitter and through said second aperture.

2. The laser-guided golf club of claim 1 wherein said means for activating comprises a push-button switch located on said grip.

3. The laser-guided golf club of claim 2 wherein said push-button switch is located 90 degrees offset from said first aperture with respect to the vertical plane.

4. The laser-guided golf club of claim 1 wherein said first portion of said laser light beam exits said first aperture parallel to the ground.

5. The laser-guided golf club of claim 1 wherein said beam splitter is adjustable to direct said first portion of said laser light beam through said first aperture within a range of angles in a horizontal plane.

6. The laser-guided golf club of claim 1 wherein said laser generating means is a laser pointer.

7. The laser-guided golf club of claim 1 wherein said laser generating means is a battery operated, laser diode semiconductor.

8. The laser-guided golf club of claim 7 wherein said laser diode semiconductor emits a visible spectrum laser light beam.

9. The laser-guided golf club of claim 1 further including a plurality of elastomer rings encircling said laser generating means to secure said laser generating means within said shaft.

10. The laser-guided golf club of claim 9 wherein said elastomer rings are rubber.

11. The laser-guided golf club of claim 1 wherein said beam splitter is contained within a threaded cylinder that is adapted to fit substantially within said second aperture.

12. The laser-guided golf club of claim 1 wherein said second aperture is shaped to allow only a selected shape of said second portion of said laser beam to pass therethrough.

* * * * *